US007513231B2

(12) United States Patent
Ezaki et al.

(10) Patent No.: US 7,513,231 B2
(45) Date of Patent: Apr. 7, 2009

(54) VALVE GEAR OF INTERNAL COMBUSTION ENGINE

(75) Inventors: Shuichi Ezaki, Susono (JP); Toshiaki Asada, Mishima (JP); Kimitoshi Tsuji, Susono (JP); Yasushi Kusaka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 306 days.

(21) Appl. No.: 10/582,120

(22) PCT Filed: Dec. 15, 2004

(86) PCT No.: PCT/JP2004/019147

§ 371 (c)(1),
(2), (4) Date: Jun. 8, 2006

(87) PCT Pub. No.: WO2005/059319

PCT Pub. Date: Jun. 30, 2005

(65) Prior Publication Data

US 2007/0113806 A1 May 24, 2007

(30) Foreign Application Priority Data

Dec. 17, 2003 (JP) ..... 2003-419391

(51) Int. Cl.
*F01L 1/34* (2006.01)

(52) U.S. Cl. ..... 123/90.17; 123/90.44; 123/345; 123/90.11; 123/90.16; 74/569

(58) Field of Classification Search ..... 123/90.17, 123/90.11, 90.15, 90.16, 90.18, 90.27, 90.31, 123/90.39, 90.44, 90.6, 345, 346; 74/559, 74/567, 569

See application file for complete search history.

(56) References Cited

U.S. PATENT DOCUMENTS

| | | | | |
|---|---|---|---|---|
| 5,327,856 | A | 7/1994 | Schroeder et al. | |
| 5,598,814 | A * | 2/1997 | Schroeder et al. | 123/90.11 |
| 6,755,166 | B2 * | 6/2004 | Chang et al. | 123/90.26 |
| 6,782,853 | B2 * | 8/2004 | Kanamaru et al. | 123/90.15 |
| 2003/0051688 | A1 | 3/2003 | Chang et al. | |

FOREIGN PATENT DOCUMENTS

| | | |
|---|---|---|
| FR | 2 608 675 | 6/1988 |
| JP | A 59-68509 | 4/1984 |
| JP | U 60-131609 | 9/1985 |
| JP | A 8-177536 | 7/1996 |
| WO | WO 03/025353 A1 | 3/2003 |

* cited by examiner

*Primary Examiner*—Ching Chang
(74) *Attorney, Agent, or Firm*—Oliff & Berridge, PLC

(57) ABSTRACT

There is provided a valve gear (11) with a motor (12), a cam mechanism (14) which converts a rotational motion of the motor (12) into a linear motion of an intake valve (2) by a cam (21), and a motor control apparatus (30) which controls the motor (12) such that an acceleration characteristic during a lift of the intake valve (2) changes in correspondence to a rotation number of an internal combustion engine.

3 Claims, 7 Drawing Sheets

VALVE GEAR OF INTERNAL COMBUSTION ENGINE

TECHNICAL FIELD

The present invention relates to a valve gear driving an intake valve or an exhaust valve of an internal combustion engine.

BACKGROUND ART

As this kind of valve gear, there has been known a valve gear which opens and closes the intake valve by rotating a cam shaft of the internal combustion engine by a stepping motor (Japanese Patent Application Laid-Open (JP-A) No. 8-177536). In addition, there is JP-A No. 59-68509 as a prior technical document relevant to the present invention.

A cam shaft torque caused by a valve spring and inertia is applied to the cam shaft as a resistance against the rotation. However, the cam shaft torque is fluctuated in correspondence to a rotation number (a rotating speed) of the engine, and there is a possibility that a rotation region in which a desired valve gear characteristic cannot be obtained is generated due to the fluctuation.

DISCLOSURE OF THE INVENTION

Accordingly, one object of the present invention is to provide a valve gear of an internal combustion engine which can maintain a high control accuracy of a valve gear characteristic of a valve regardless of a change of an engine rotation number.

In order to achieve the above object, in accordance with one aspect of the present invention, there is provided a valve gear of an internal combustion engine comprising: an electric motor; a cam mechanism which converts a rotational motion of the electric motor into a linear motion of a valve for opening and closing a cylinder by a cam; and an electric motor control device which controls the electric motor such that an acceleration characteristic during a lift of the valve changes in correspondence to a rotation number of the internal combustion engine.

To a cam shaft, there are applied, as a cam shaft torque, a valve spring torque which is generated in accordance with a compression reaction force of a valve spring energizing the valve and an inertia torque which is generated in accordance with an inertia force of a valve gear system parts reciprocating in synchronization with the valve. When the cam shaft is rotated at a low speed, the valve spring torque is predominantly applied as the cam shaft torque. The valve spring torque is obtained by a product of the compression reaction force of the valve spring and a distance (an offset amount) in a direction orthogonal to a reciprocating direction of the valve from a rotation center of the cam to a contact position thereof with an opposing part. Further, the compression reaction force is increased in proportion to the lift amount of the valve, and a lift speed of the valve is increased in proportion to the offset amount. Accordingly, in order to reduce the cam shaft torque in the low rotation region, it is preferable to design a profile of the cam such that the lift speed becomes maximum at a stage where the lift amount is as small as possible.

On the other hand, the inertia torque of the cam shaft is increased in proportion to a square of the rotating speed, and when the cam shaft is rotated at a high speed, an influence of the inertia torque is relatively increased, and the cam shaft torque becomes maximum at a position at which the acceleration of the valve becomes maximum. When the lift speed is increased to the maximum for a short time from the lift start, the acceleration of the valve is increased. Accordingly, the cam shaft torque at the time of the high rotation of the cam shaft is significantly increased. Therefore, in order to reduce the cam shaft torque in the high rotation region, it is necessary to design the profile of the cam such that the maximum acceleration of the valve becomes small.

As mentioned above, the valve spring torque and the inertia torque have an antinomy relation. Even if the cam is designed such as to reduce the cam shaft torque in any one rotation region of the low rotation region and the high rotation region of the cam shaft, the cam shaft torque is increased in the other rotation region, so that there is a possibility that a desired valve gear characteristic cannot be obtained.

However, in the case of driving the valve by the electric motor, even if the rotation number of the internal combustion engine is constant, it is possible to appropriately change the acceleration characteristic during the lift of the valve by adjusting the rotating speed of the electric motor. In the case of making good use of the above function, it is possible to restrict the cam shaft torque low regardless of the engine rotation number by changing the acceleration of the cam in such a manner as to inhibit the cam shaft torque, which is generated at a time when the cam is driven out of an optimum rotation region in view of the profile design, from being increased. For example, in the case of designing the cam so as to increase the acceleration just after starting the lift and just before finishing the lift for reducing the valve spring torque in the low rotation region, it is preferable to change the rotating speed of the electric motor such that the lift acceleration just after starting the lift and just before finishing the lift is restricted in the high rotation region. On the contrary, in the case of designing the cam so as to restrict the acceleration just after starting the lift and just before finishing the lift for reducing the inertia torque in the high rotation region, it is preferable to change the rotating speed of the electric motor such that the lift acceleration just after starting the lift and just before finishing the lift is increased in the low rotation region.

In the valve gear in accordance with the above aspect of the present invention, the electric motor control device may control the electric motor such that when the rotation number of the internal combustion engine is low, the speed of the cam in predetermined sections after starting the lift of the valve and before finishing the lift becomes higher than the speed of the cam in a section between the predetermined sections, and when the rotation number of the internal combustion engine is high, the cam is rotated at a constant speed during the lift of the valve. In this case, in the low speed region, it is possible to apply the maximum speed to the valve at the stage where the lift amount of the valve is small, thereby restricting the valve spring torque. In the high rotation region, it is possible to lighten a load for controlling the electric motor at the time of the high rotation by rotating the cam at a constant speed, thereby preventing the deterioration of the motion control of the valve due to a lack of response of the control. In the above aspect, the electric motor control device may control the electric motor such that a difference of the rotating speed of the cam is reduced between the predetermined sections and the intermediate section in accordance with an increase of the rotation number of the internal combustion engine, by changing the speed in the above manner. In this case, it is possible to smoothly change the acceleration characteristic of the valve with respect to the change of the rotation number of the internal combustion engine, thereby preventing drivability from being deteriorated.

Further, in the valve gear in accordance with the above aspect of the present invention, the electric motor control device may control the electric motor such that when the rotation number of the internal combustion engine is low, the cam is rotated at a constant speed during the lift, and when the rotation number of the internal combustion engine is high, the speed of the cam in predetermined sections after starting the lift of the valve and before finishing the lift becomes lower than the speed of the cam in an intermediate section between the predetermined sections. In this case, it is possible to restrict the inertia torque by reducing the maximum acceleration of the valve in the high speed region. In the above aspect, the electric motor control device may control the electric motor such that a difference of the rotating speed of the cam is increased between the predetermined sections and the intermediate section in accordance with an increase of the rotation number of the internal combustion engine. In this case, it is possible to smoothly change the acceleration characteristic of the valve with respect to the change of the speed of the internal combustion engine, by changing the speed in the above manner, thereby preventing drivability from being deteriorated.

According to another aspect of the present invention, there is provided a valve gear of an internal combustion engine comprising: an electric motor; a cam mechanism which converts a rotational motion of the electric motor into a linear motion of a valve for opening and closing a cylinder by a cam; and electric motor control means for controlling the electric motor such that an acceleration characteristic during a lift of the valve changes in correspondence to a rotation number of the internal combustion engine.

BEST MODE FOR CARRYING OUT THE INVENTION

First Embodiment

Figure 1:
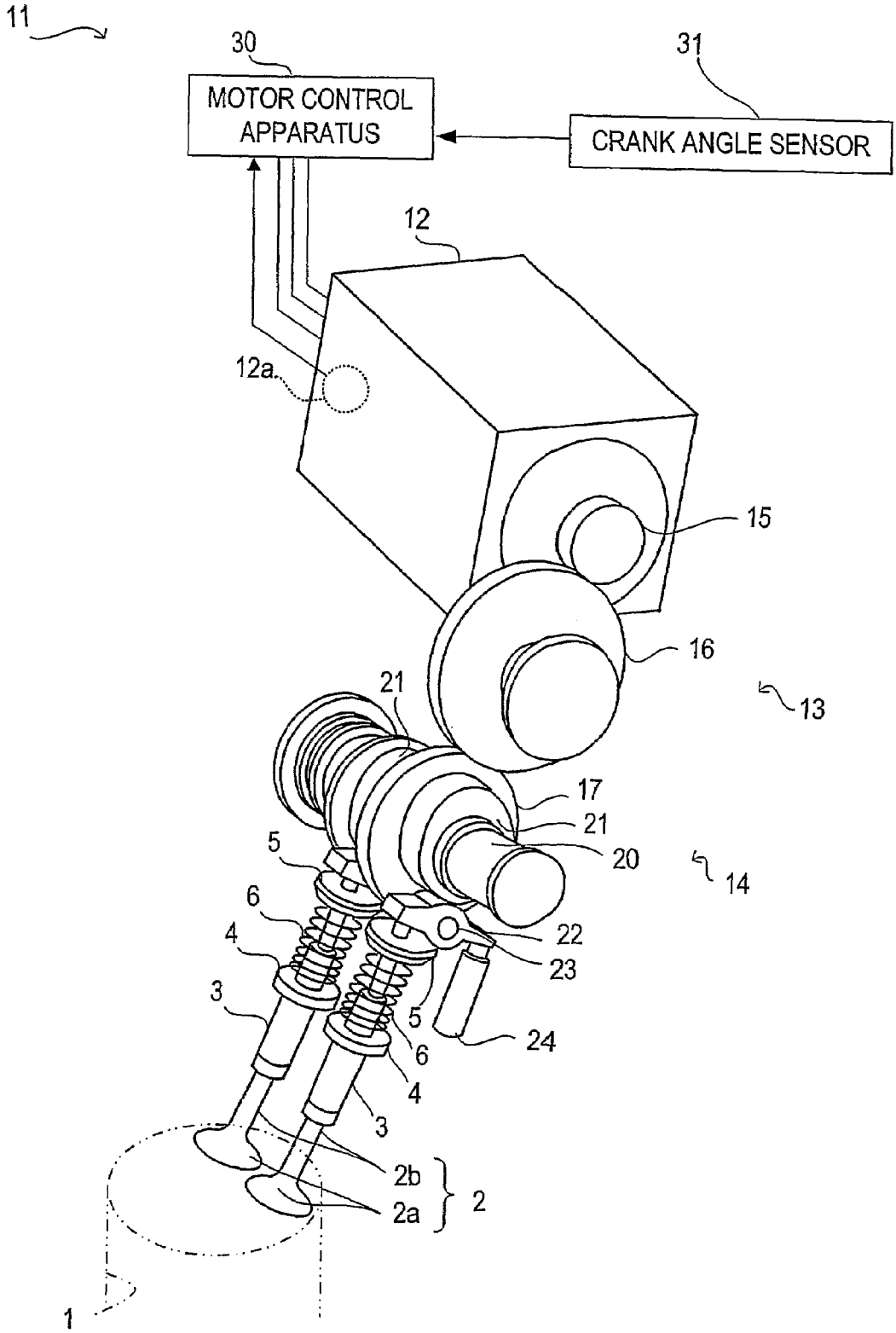
FIG. 1 is a perspective view of a valve gear in accordance with an embodiment of the present invention.

FIG. 1 shows an embodiment in which a valve gear in accordance with the present invention is applied so as to drive an intake valve of a reciprocal type internal combustion engine. In this embodiment, two intake valves 2 are provided in each of cylinders 1 (only one is illustrated in the drawing) provided in the internal combustion engine, and the intake valve 2 is driven so as to be opened and closed by a valve gear 11 provided in each of the cylinders 1. As is well known, the intake valve 2 has a valve head 2*a* and a stem 2*b*. The stem 2*b* is passed through a sleeve 3 fixed to a cylinder head (not shown), whereby the intake valve 2 is slidably guided in an axial direction of the stem 2*b*. A valve spring 6 is arranged between a flange 4 protruding from the sleeve 3 and a valve spring retainer 5 attached to the stem 2*b* in a compressed state, and the intake valve 2 is energized in a direction of being in close contact with a valve seat (not shown), that is, to an upper side in FIG. 1 on the basis of a compression reaction force of the valve spring 6.

The valve gear 11 on the intake side is provided with an electric motor (hereinafter, refer to as a motor) 12 serving as a drive source, a gear train 13 corresponding to a transfer mechanism for transferring a rotational motion of the motor 12, and a cam mechanism 14 which converts the rotational motion transferred from the gear train 13 into a linear opening and closing motion of the intake valve 2. As the motor 12, there is employed a DC brushless motor or the like in which a rotational speed can be controlled. The motor 12 has therein a position detecting sensor 12*a* such as a resolver, a rotary encoder or the like for detecting a rotational position of the motor. The gear train 13 transfers a rotation of a motor gear 15 mounted to an output shaft (not shown) of the motor 12 to a cam driving gear 17 via an intermediate gear 16. The gear train 13 may be structured such that the motor gear 15 and the cam driving gear 17 are rotated at a uniform speed, or may be structured such that a speed of the cam driving gear 17 is increased or reduced with respect to the motor gear 15.

Figure 2:
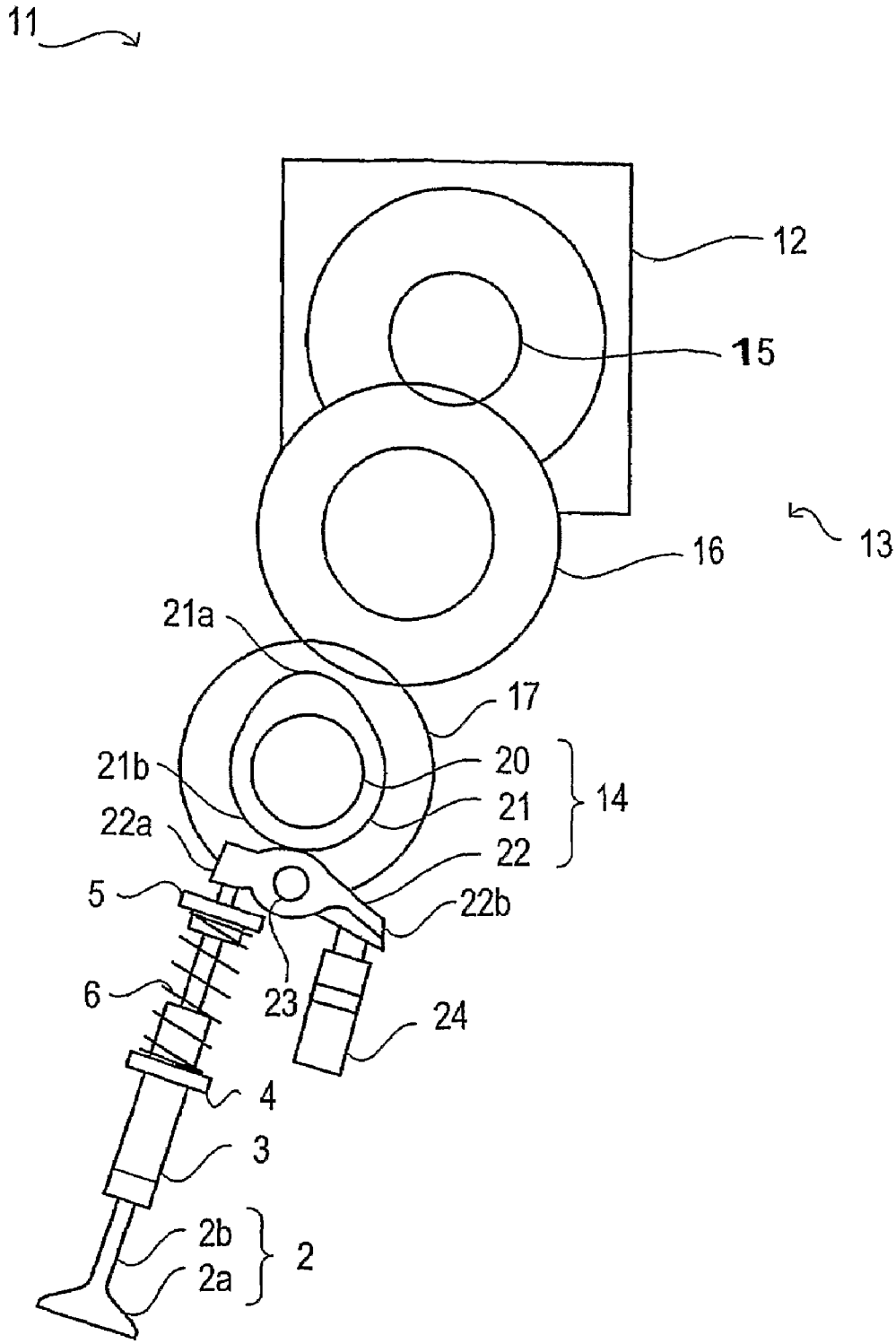
FIG. 2 is a front elevational view of the valve gear in FIG. 1.

As is also shown in FIG. 2, the cam mechanism 14 is provided with a cam shaft 20 which is provided so as to be coaxially and integrally rotated with the cam driving gear 17, two cams 21 which are provided so as to be integrally rotated with the cam shaft 20, and a rocker arm 22 which is provided between each of the cams 21 and the intake valve 2. The cam 21 is formed as one kind of plate cam on which a nose 21*a* is formed by protruding a part of a circular arc base circle 21*b* coaxially formed with the cam shaft 20 toward an outer side in a radial direction.

The rocker arm 22 is rotatably mounted to a valve rocker shaft 23, one end portion 22*a* thereof is in contact with an upper end of the stem 2*b* of the intake valve 2, and the other end portion 22*b* is in contact with a lash adjuster 24. The lash adjuster 24 pushes up the one end portion 22*a* of the rocker arm 22, whereby the one end portion 22*a* of the rocker arm 22 is kept in a state of being in contact with the upper end portion of the intake valve 2. The rocker arm 22 rocks around the valve rocker shaft 23 in accordance with the rotation of the cam 21, and the intake valve 2 executes a linear motion in an axial direction of the stem 2*b* in accordance with the rocking motion and the cylinder is opened and closed.

Returning to FIG. 1, the valve gear 11 is provided with a motor control apparatus 30 serving as an electric motor control device which controls the motion of the motor 12. The motor control apparatus 30 is a computer unit provided with a micro processor and peripheral parts such as a main storage device or the like required for a motion of the micro processor. When a plurality of valve gears 11 are provided, the motor control apparatus 30 may be shared with each of the valve gears 11. Alternatively, the motor control apparatus 30 may be provided in each of the cylinders 1 or each of the valve gears 11. The motor control apparatus may be provided for exclusively controlling the valve gear 11, or the computer unit provided for the other intended use may be used together with the motor control apparatus 30. For example, an engine control unit (ECU) for controlling a fuel injection amount of the internal combustion engine may be used as the motor control apparatus.

To the motor control apparatus 30, there are connected various sensors, such as a crank angle sensor 31 outputting a signal in correspondence to an angle of a crank shaft and the like, as information input means as well as the above position detecting sensor 12*a*. The motor control apparatus 30 controls a motion of the motor 12 in accordance with a valve control program stored in a ROM with referring to outputs from these sensors. As a control in connection with the feature of the present invention, the motor control apparatus 30 changes a rotating speed of the motor 12 such that an acceleration characteristic of the intake valve 2 is changed in correspondence to an engine rotation number of the intake valve 2. With respect to this point, a description will be given below in detail.

Figure 3:
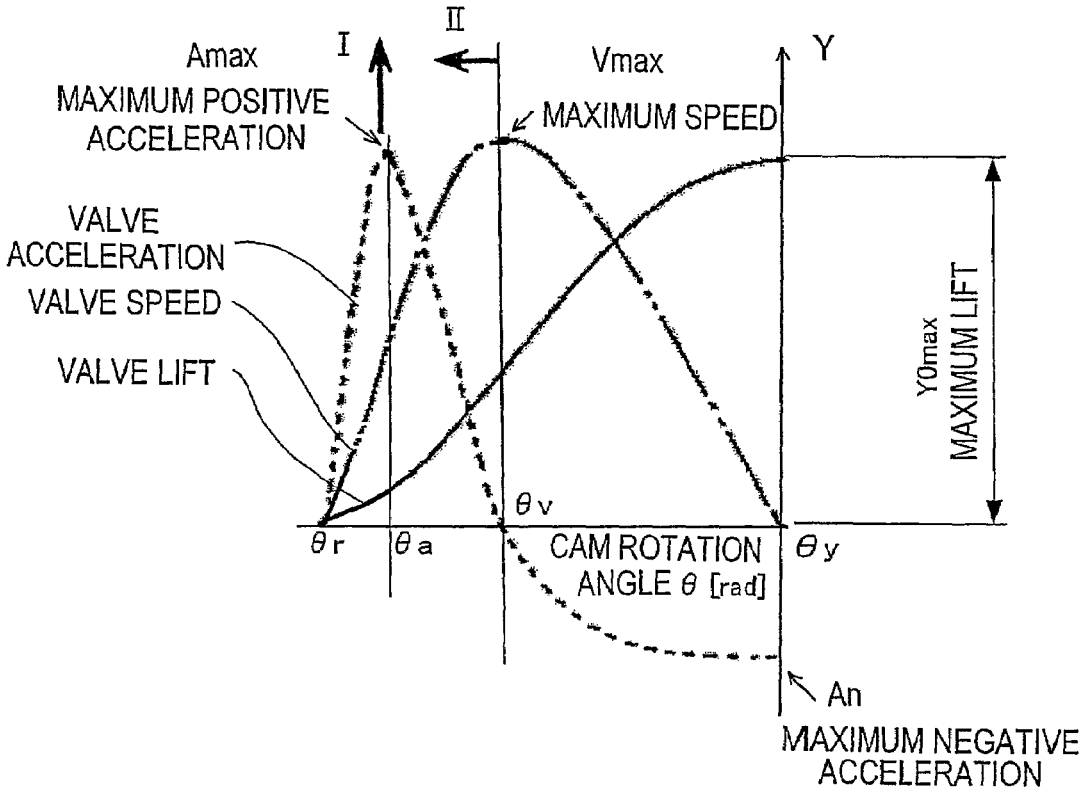
FIG. 3 is a diagram showing a lift characteristic which the valve gear in FIG. 1 applies to an intake valve.

FIG. 3 shows a corresponding relation between a lift amount Y, a lift speed V and a lift acceleration A of the intake valve 2, and a rotating angle θ of the cam 21. In this case, it is assumed that the rotating speed of the cam shaft 20 is a basic speed, that is, one half of the rotating speed of a crank shaft (an engine output shaft) of the internal combustion engine and the basic speed is maintained to be constant. Further, FIG. 3 shows a valve gear characteristic of the intake valve 2 from a cam angle (a lift start angle) θr at a time where the intake valve 2 starts lifting to a cam angle (a maximum lift angle) θy at a time when a maximum lift amount Y0max is given, and it is assumed that the valve gear characteristic from the maximum lift angle θy to the cam angle at a time when the lift of the intake valve 2 is finished appears symmetrical to a vertical axis drawn on the maximum lift angle θy. Positive and negative of the cam speed V and the cam acceleration A are defined such that a direction in which the intake valve 2 is opened is a positive direction.

In FIG. 3, the lift speed V is obtained by differentiating the lift amount Y, and the lift acceleration A is obtained by differentiating the lift speed V. Accordingly, the lift speed V reaches a maximum lift speed Vmax at a cam angle (a maximum speed cam angle) θv earlier than the maximum lift angle θy, and the lift acceleration A reaches a maximum lift acceleration in a positive direction (a maximum positive acceleration) Amax at a cam angle (a maximum acceleration cam angle) θa earlier than the lift acceleration A. As mentioned above, in order to restrict the cam shaft torque in the low rotation region, it is necessary to set the lift characteristic of the intake valve 2 such that the maximum lift speed Vmax can be obtained at a stage where the lift amount Y is as small as possible, on the other hand, in order to restrict the cam shaft torque in the high rotation region, it is necessary to restrict the maximum lift acceleration Amax. As long as the rotating speed of the cam shaft 20 is maintained constant during the lift of the intake valve 2, the lift speed V and the lift acceleration A are univocally defined on the basis of a profile of the cam 21. Accordingly, it is impossible to quicken the maximum speed cam angle θv while reducing the maximum acceleration Amax.

Accordingly, first giving priority to the restriction of the inertia torque in the high rotation region, the profile of the cam 21 is designed such that the maximum acceleration Amax in the maximum rotation number of the internal combustion engine is lowered to an allowable limit. In this case, if the cam 21 is driven at the basic speed during the lift of the intake valve 2, the maximum speed cam angle θv is delayed, and the valve spring torque in the low rotation region is increased. In order to avoid this, the rotating speed of the motor 12 just after starting the lift and just before finishing the lift is increased more than the basic speed in the low rotation region, thereby increasing the maximum acceleration Amax of the intake valve 2 as shown by an arrow I in FIG. 3. Accordingly, it is possible to quicken the maximum speed cam angle θv as shown by an arrow II so as to restrict the valve spring torque, thereby lowering the cam shaft torque.

Figure 4:
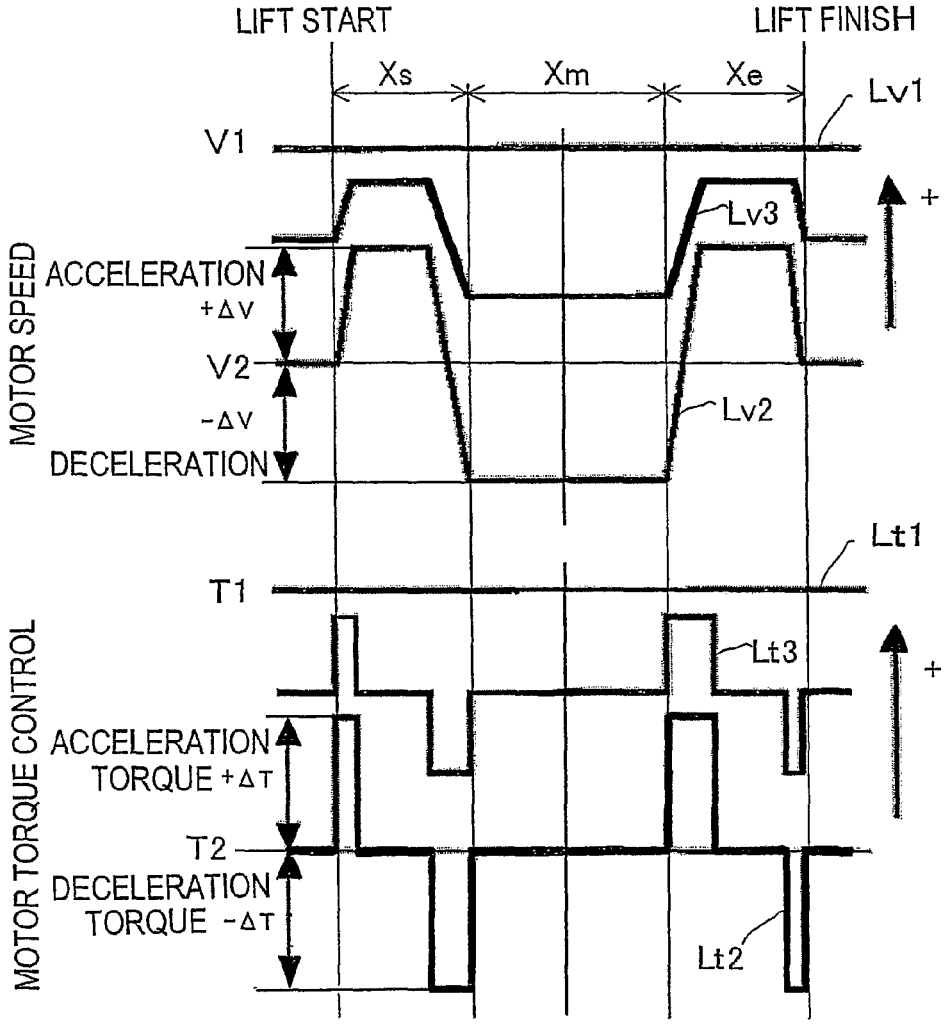
FIG. 4 is a time chart showing a control of a motor speed and a motor torque by a motor control apparatus in FIG. 1.

FIG. 4 is a time chart showing a change of a rotating speed (a motor speed) and an output torque (a motor torque) of the motor 12 which the motor control apparatus 30 controls for changing the acceleration characteristic of the intake valve 2 in the above manner. In the drawing, it is assumed that the cam 21 is continuously rotated in the same direction by the motor 12 regardless of the engine rotation number.

When the internal combustion engine is operated at the maximum rotation number, the motor control apparatus 30 fixes the motor torque to a constant value T1 as shown by a solid line Lt1 in FIG. 4, and fixes the rotating speed of the motor 12 to a constant speed V1 as shown by a solid line Lv1. The speed V1 is equal to the rotating speed of the motor 12 which is necessary for rotating the cam 21 at the basic speed corresponding to one half of the maximum rotation number of the crank shaft. On the contrary, when the internal combustion engine is operated at an idling rotation number, the motor control apparatus 30 increases and reduces the motor torque with respect to a torque T2 which is necessary for driving the cam 21 at the basic speed at the idling time, in a predetermined section Xs just after starting the lift and a predetermined section and Xe just before finishing the lift as shown by a solid line Lt2 in the drawing, thereby increasing the rotating speed of the motor 12 in the sections Xs and Xe higher than the speed V2 corresponding to the basic speed at the idling time. In an intermediate section Xm during the lift between the sections Xs and Xe, the motor torque is maintained at T2, and the motor speed is set lower than the speed V2. The reason is to make a valve time area (an area in a region surrounded by a curve of the lift amount) of the intake valve 2 accord with that in the case of driving the motor 12 at the constant speed V2.

Figure 5:
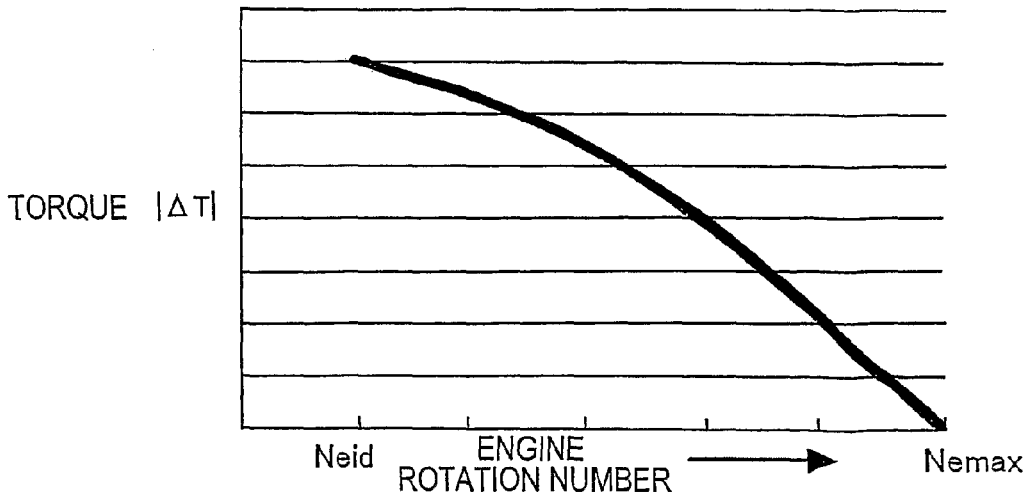
FIG. 5 is a graph showing a corresponding relation between an absolute value $\Delta|T|$ of a motor torque difference in FIG. 4 and an engine rotation number.

When the internal combustion engine is operated at the intermediate rotation number between the idling rotation number and the maximum rotation number, the motor control apparatus 30 increases and reduces the motor torque and the motor speed in the predetermined sections Xs and Xe just after starting the lift and just before finishing the lift as shown by solid lines Lt3 and Lv3 in FIG. 4, however, differences of the motor speed and torque at that time are controlled small in accordance with the increase of the engine rotation number. For example, on the assumption that an absolute value of the difference of the motor torque to be applied just after starting the lift and just before finishing the lift is set to Δ|T| as shown in FIG. 4, the value Δ|T| is set small as the engine rotation number is increased as shown in FIG. 5, and the relation Δ|T|=0, that is, an operating state at a constant speed with no acceleration is achieved at the time of reaching a maximum rotation number Nemax.

When the torque and the speed of the motor 12 are controlled as mentioned above, even if the profile of the cam 21 is designed while giving priority to the restriction of the inertia torque at the maximum rotation number, it is possible to change the acceleration characteristic of the intake valve 2 in the low rotation region such that the maximum lift speed Vmax is generated in the limited sections Xs and Xe just after starting the lift and just before finishing the lift in which the lift amount is comparatively small, whereby it is possible to restrict the valve spring torque in the low rotation region so as to lower the load applied to the motor 12.

Second Embodiment

Figure 6:
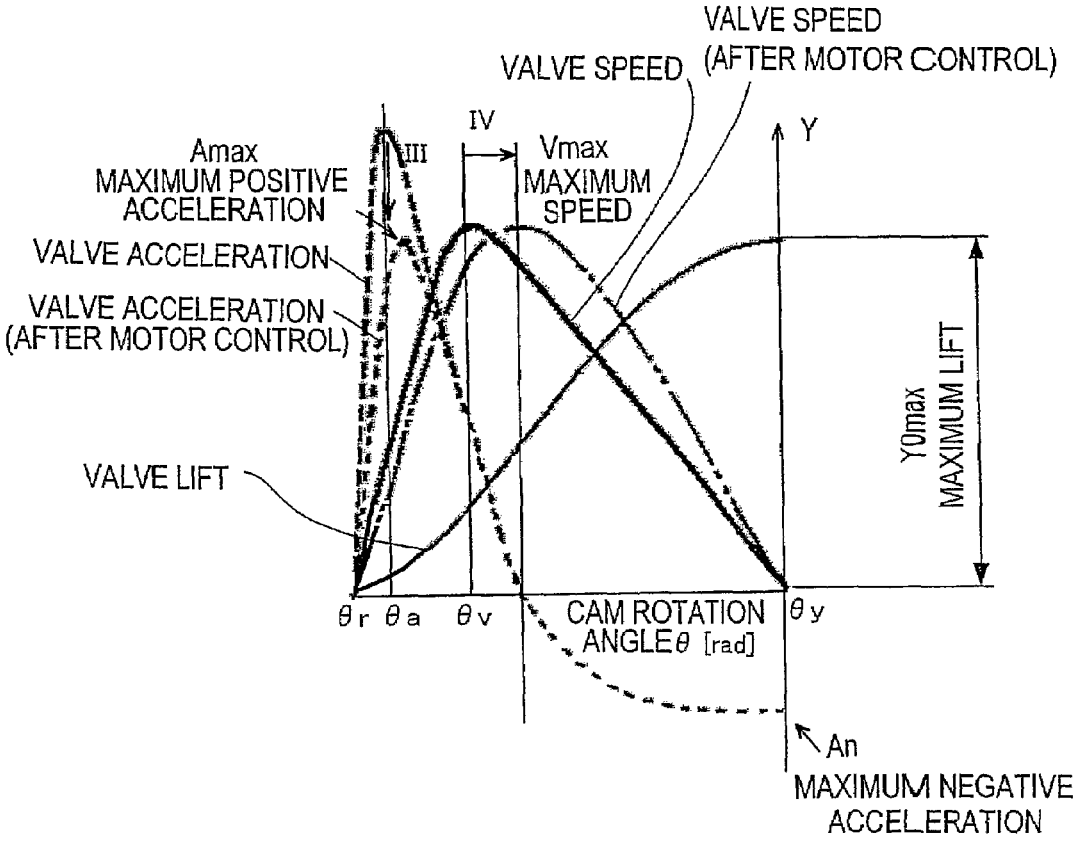
FIG. 6 is a diagram showing another example of the lift characteristic which the valve gear in FIG. 1 applies to the intake valve.

In the first embodiment, the profile of the cam 21 is designed while giving priority to the reduction of the inertia torque in the high rotation region, however, the present invention may be realized on the opposite aspect. One embodiment thereof will be shown in FIGS. 6 to 8.

In this embodiment, first on the assumption that giving priority to the restriction of the valve spring torque in the low rotation region, the profile of the cam 21 is designed such that the maximum speed cam angle θv giving the maximum lift speed Vmax becomes as early as possible. In this case, if the cam 21 is driven at the basic speed regardless of the engine rotation number, the maximum acceleration Amax just after starting the lift and just before finishing the lift is increased in proportion to a square of the increase of the engine rotation number, and the inertia torque in the high rotation region is significantly enlarged. In order to avoid this, the rotating speed of the motor 12 is changed such that the maximum acceleration of the intake valve 2 just after starting the lift and just before finishing the lift is lowered in inverse proportion to a square of the rotating speed, as the engine rotation number is increased from the idling rotation number. Accordingly, it is possible to restrict the maximum acceleration Amax of the intake valve 2 as shown by an arrow III in FIG. 6, and it is possible to delay the maximum speed cam angle θv as shown by an arrow IV so as to inhibit the inertia torque from being increased in the high rotation region.

Figure 7:
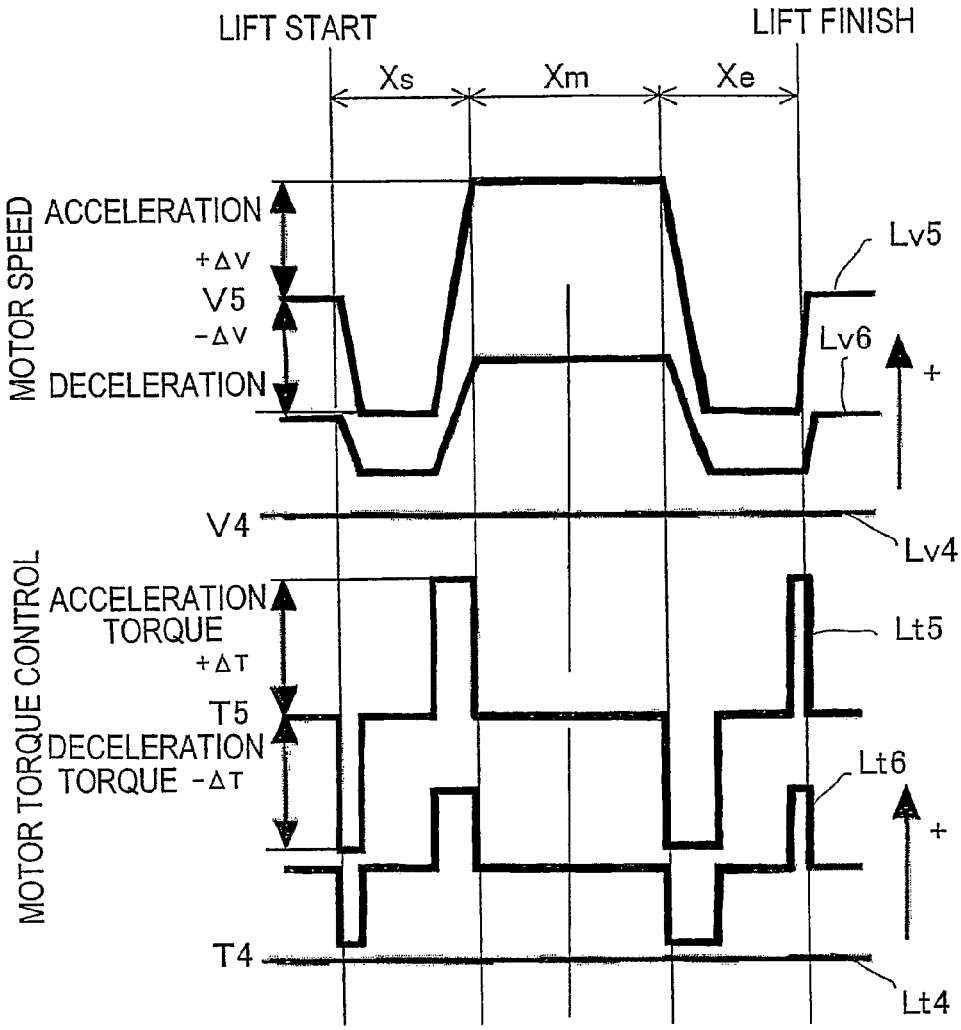
FIG. 7 is a time chart showing another example of the control of the motor speed and the motor torque by the motor control apparatus in FIG. 1.

FIG. 7 is a time chart showing a change of a rotating speed (a motor speed) and an output torque (a motor torque) of the motor 12 which the motor control apparatus 30 controls for changing the acceleration characteristic of the intake valve 2 in the above manner. In the drawing, it is assumed that the cam 21 is continuously rotated in the same direction by the motor 12 regardless of the engine rotation number.

When the internal combustion engine is rotated at the idling rotation number, the motor control apparatus 30 fixes the motor torque to a constant value T4 as shown by a solid line Lt4 in FIG. 7, and fixes the rotating speed of the motor 12 to a constant speed V4 as shown by a solid line Lv4. The speed V4 is equal to the rotating speed of the motor 12 which is necessary for rotating the cam 21 at the basic speed at a time when the internal combustion engine is operated at the idling rotation number. On the contrary, when the internal combustion engine is operated at the maximum rotation number, the motor control apparatus 30 increases and reduces the motor torque with respect to a torque T5 which is necessary for driving the cam 21 at the basic speed corresponding to the maximum rotation number, in the predetermined sections Xs and Xe just after starting the lift and just before finishing the lift as shown by a solid line Lt5 in the drawing, thereby making the rotating speed of the motor 12 in the sections Xs and Xe lower than the speed V5 necessary for driving the cam 21 at the basic speed corresponding to the maximum rotation number. In an intermediate section Xm during the lift between the sections Xs and Xe, the motor control apparatus 30 maintains the motor torque at T5, and sets the rotating speed of the motor 12 higher than the speed V5. The reason is to make a valve time area (an area in a range surrounded by a curve of the lift amount) of the intake valve 2 accord with that in the case of driving the motor 12 at the constant speed V5.

When the internal combustion engine is operated at the intermediate rotation number between the idling rotation number and the maximum rotation number, the motor control apparatus 30 changes the motor torque and the motor speed in the predetermined sections Xs and Xe just after starting the lift and just before finishing the lift as shown by solid lines Lt6 and Lv6 in FIG. 7, however, differences of the motor speed and torque at that time become larger as the engine rotation number is increased. For example, on the assumption that an absolute value of the difference of the motor torque to be applied just after starting the lift and just before finishing the lift is set to Δ|T| as shown in FIG. 7, the relation Δ|T|=0, that is, an operating state at a constant speed with no acceleration is achieved at an idling rotation number Neid as shown in FIG. 8, however, the absolute value |T| of the torque difference is increased as the rotation number is increased, and the torque is increased and reduced largest at a high rotation number Nemax.

When the torque and the speed of the motor 12 are controlled as mentioned above, even if the profile of the cam 21 is designed such as to restrict the valve spring torque in the low rotation region, it is possible to inhibit the maximum acceleration of the intake valve 2 in the high rotation region from being increased, whereby it is possible to restrict the inertia torque small so as to lower the load applied to the motor 12.

The present invention is not limited to the above embodiments, but may be executed on the basis of various embodiments. For example, in the above embodiments, the motor 12 is continuously rotated in the same direction regardless of the engine rotation number, however, the present invention can be applied to a case that the motor 12 is operated in a rocking drive mode in which the rotating direction of the cam 21 is changed before reaching the cam angle at which the maximum lift amount is obtained. The valve gear 11 may be provided divisionally in each of the cylinders, or one valve gear 11 may be shared with a plurality of cylinders 1. The present invention may be applied to the valve gear driving the exhaust valve. The present invention can be applied to a so-called direct-push type valve gear in which the cam and the intake valve are directly brought into contact with each other with using no rocker arm.

Figure 8:
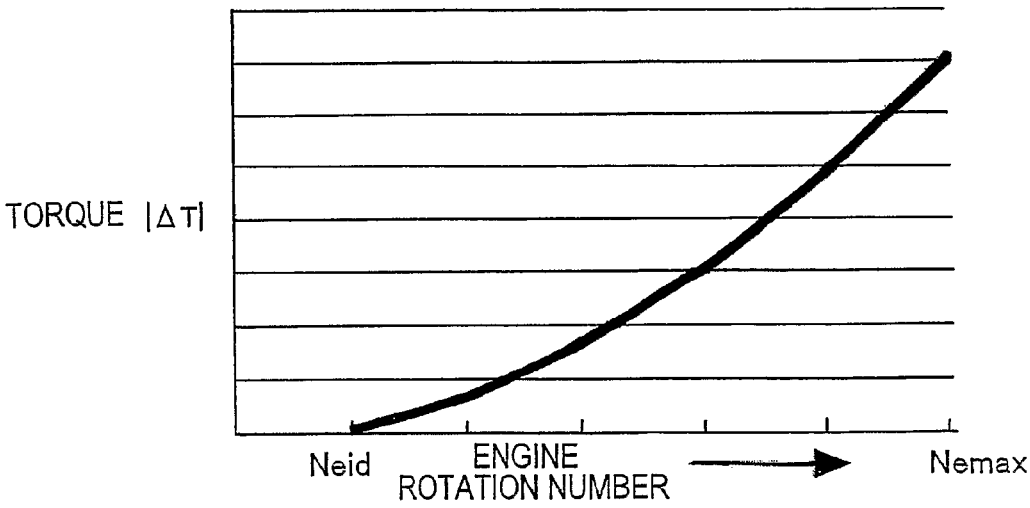
FIG. 8 is a graph showing a corresponding relation between an absolute value $\Delta|T|$ of a motor torque difference in FIG. 7 and an engine rotation number.
Figure 9:
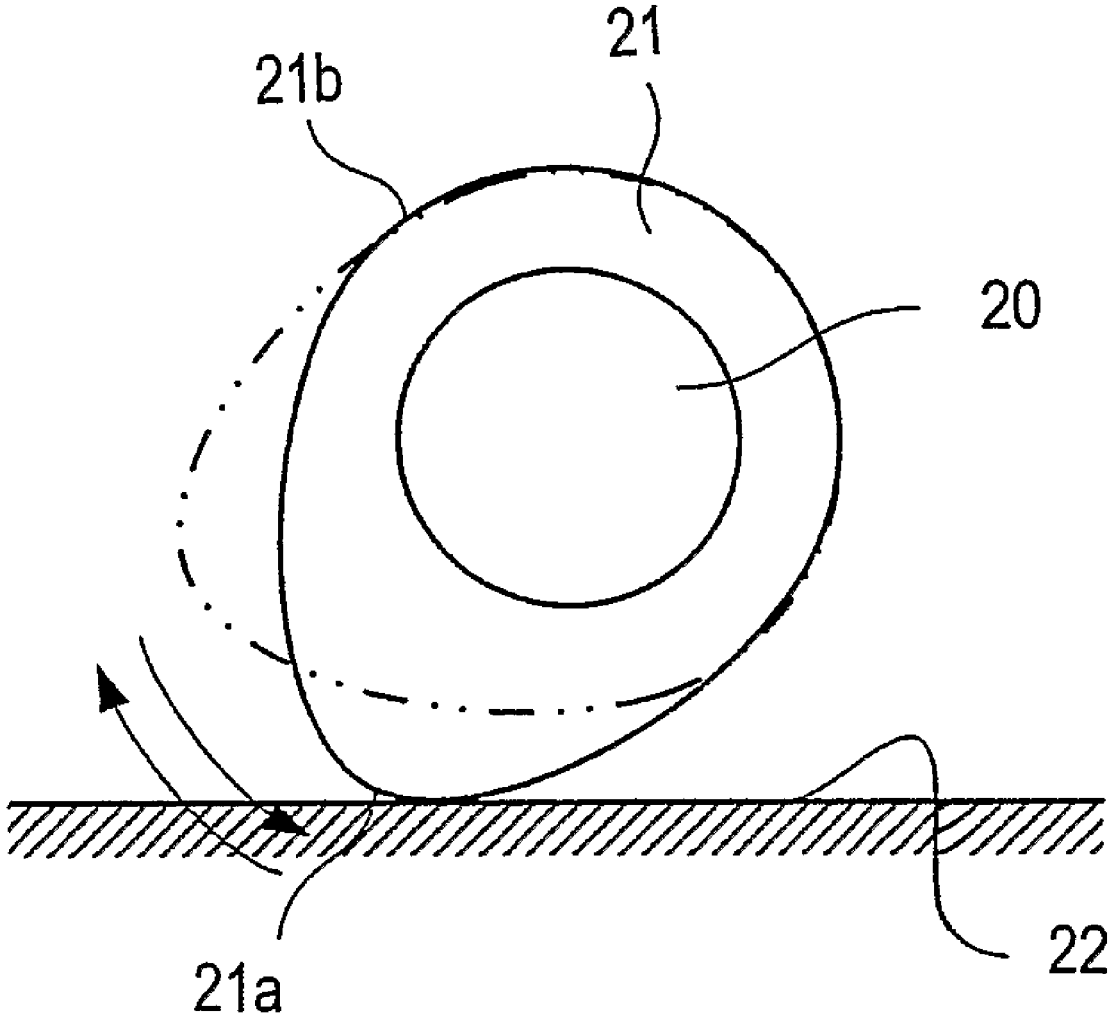
FIG. 9 is a view showing a motion of a cam in a rocking drive mode.

In the above embodiments, since the absolute value Δ|T| of the difference of the motor torque is continuously changed as shown in FIG. 5 or 8, it is possible to inhibit the lift characteristic of the intake valve 2 from being discontinuously changed in accordance with the change of the rotation number of the internal combustion engine, whereby it is possible to prevent the drivability from being deteriorated. However, the present invention is not limited to the embodiment which applies the continuous change as mentioned above, but the differences of the motor torque and motor speed may be intermittently changed in a finite stage number equal to or more than two. The present invention is not limited to the 4-cycle internal combustion engine in which the crank shaft serving as the engine output shaft rotates at two times from the start of the intake stroke to the end of the exhaust stroke, but may be applied to a 2-cycle internal combustion engine in which the strokes from the intake to the exhaust are finished during one rotation of the engine output shaft. In this case, the basic speed of the cam coincides with the rotating speed of the engine output shaft. In other words, the basic speed at the time of rotating the cam is defined as a speed obtained by dividing the rotating speed of the engine output shaft of the internal combustion engine by the rotation number of the engine output shaft from the start of the intake stroke to the end of the exhaust stroke.

The invention claimed is:

1. A valve gear of an internal combustion engine comprising:

an electric motor;

a cam mechanism which converts a rotational motion of the electric motor into a linear motion of a valve for opening and closing a cylinder by a cam; and an electric motor control device which controls the electric motor such that an acceleration characteristic during a lift of the valve changes in correspondence to a rotation number of the internal combustion engine, wherein the electric motor control device controls the electric motor such that when the rotation number of the internal combustion engine is low, the speed of the cam in predetermined sections after starting the lift of the valve and before finishing the lift becomes higher than the speed of the cam in an intermediate section between the predetermined sections, and when the rotation number of the internal combustion engine is high, the cam is rotated at a constant speed during the lift of the valve, and a difference of the rotating speed of the cam is reduced between the predetermined sections and the intermediate section in accordance with an increase of the rotation number of the internal combustion engine.

2. A valve gear of an internal combustion engine comprising:

an electric motor;

a cam mechanism which converts a rotational motion of the electric motor into a linear motion of a valve for opening and closing a cylinder by a cam; and an electric motor control device which controls the electric motor such that an acceleration characteristic during a lift of the valve changes in correspondence to a rotation number of the internal combustion engine, wherein the electric motor control device controls the electric motor such that when the rotation number of the internal combustion engine is low, the cam is rotated at a constant speed during the lift, and when the rotation number of the internal combustion engine is high, the speed of the cam in predetermined sections after starting the lift of the valve and before finishing the lift becomes lower than the speed of the cam in an intermediate section between the predetermined sections, and a difference of the rotating speed of the cam is increased between the predetermined section and the intermediate sections in accordance with an increase of the rotation number of the internal combustion engine.

3. A valve gear of an internal combustion engine comprising:

an electric motor;

a cam mechanism which converts a rotational motion of the electric motor into a linear motion of a valve for opening and closing a cylinder by a cam, a profile of the cam being designed such as to restrict a cam shaft torque at a predetermined rotation region; and an electric motor control device which controls the electric motor such that an acceleration characteristic during a lift of the valve changes in correspondence to a rotation number of the internal combustion engine, wherein the electric motor control device controls the electric motor such that an increase of the cam shaft torque which is generated at a time when the cam is driven out of the predetermined rotation region in view of the profile design is restricted.

* * * * *